US009710985B2

(12) United States Patent
Tomita et al.

(10) Patent No.: US 9,710,985 B2
(45) Date of Patent: Jul. 18, 2017

(54) VEHICLE CONTROL APPARATUS

(71) Applicants: Yosuke Tomita, Aichi (JP); Naoyuki Ishihara, Aichi (JP); Tetsuo Nishidai, Aichi (JP); Takahiro Inaguma, Aichi (JP); Kazuya Hamada, Aichi (JP)

(72) Inventors: Yosuke Tomita, Aichi (JP); Naoyuki Ishihara, Aichi (JP); Tetsuo Nishidai, Aichi (JP); Takahiro Inaguma, Aichi (JP); Kazuya Hamada, Aichi (JP)

(73) Assignee: OMRON AUTOMOTIVE ELECTRONICS CO., LTD., Aichi (JP)

( * ) Notice: Subject to any disclaimer, the term of this patent is extended or adjusted under 35 U.S.C. 154(b) by 0 days.

(21) Appl. No.: 15/057,565

(22) Filed: Mar. 1, 2016

(65) Prior Publication Data

US 2016/0275732 A1 Sep. 22, 2016

(30) Foreign Application Priority Data

Mar. 20, 2015 (JP) ..... 2015-057543
Apr. 10, 2015 (JP) ..... 2015-080801

(51) Int. Cl.
*G07F 7/04* (2006.01)
*G07C 9/00* (2006.01)

(52) U.S. Cl.
CPC ..... *G07C 9/00309* (2013.01); *G07C 9/00182* (2013.01)

(58) Field of Classification Search
CPC ..... B60R 25/24; G07C 2009/00587; G07C 2009/00642; G07C 9/00182; G07C 9/00309
(Continued)

(56) References Cited

U.S. PATENT DOCUMENTS 6,670,883 B1 * 12/2003 Asakura ..... B60R 25/24 307/10.1
7,034,657 B2 * 4/2006 Ueda ..... E05B 85/01 340/5.62
(Continued)

FOREIGN PATENT DOCUMENTS

JP H10-297430 A 11/1998
JP 2001-098810 A 4/2001
(Continued)

*Primary Examiner* — Carlos E Garcia
(74) *Attorney, Agent, or Firm* — Osha Liang LLP

(57) ABSTRACT

A vehicle control apparatus includes: a vehicle-mounted transmitter which transmits a first response request signal; a vehicle-mounted receiver which receives, from a portable device, a response signal to the first response request signal; and a controller which allows an operation for welcoming a user carrying the portable device to a vehicle according to a reception state of the response signal. When intermittently transmitting the first response request signal at predetermined intervals via the vehicle-mounted transmitter, the controller determines whether condition set in advance is established. When the condition is established, the controller transmits a second response request signal different from the first response request signal. According to whether the vehicle-mounted receiver receives, from the portable device, a response signal to the second response request signal, the controller stops transmission of the second response request signal and then suppresses transmission of the first response request signal.

12 Claims, 12 Drawing Sheets

(58) Field of Classification Search
USPC ..... 340/5.6, 5.61, 5.64, 5.7
See application file for complete search history.

(56) References Cited

U.S. PATENT DOCUMENTS

| | | | | |
|---|---|---|---|---|
| 7,629,876 | B2 * | 12/2009 | Nagai | B60R 25/24 340/426.13 |
| 7,778,743 | B2 * | 8/2010 | Arie | B60R 25/246 307/10.7 |
| 7,999,655 | B2 * | 8/2011 | Yoshikawa | B60R 25/04 340/426.13 |
| 8,077,011 | B2 * | 12/2011 | McBride | B60R 25/245 340/10.1 |
| 8,571,738 | B1 * | 10/2013 | Potter | B60L 3/0046 324/434 |
| 9,126,564 | B2 * | 9/2015 | Ono | B60R 25/24 |
| 2015/0213295 | A1 * | 7/2015 | Ginsburg | H04W 64/00 340/10.1 |
| 2016/0275732 | A1 * | 9/2016 | Tomita | G07C 9/00111 |

FOREIGN PATENT DOCUMENTS

| | | | |
|---|---|---|---|
| JP | 2005-127050 | A | 5/2005 |
| JP | 2008-038514 | A | 2/2008 |
| JP | 2012-036669 | A | 2/2012 |

* cited by examiner

VEHICLE CONTROL APPARATUS

CROSS-REFERENCES TO RELATED APPLICATIONS

This application is based upon and claims the benefit of priority from Japanese Patent Application No. 2015-057543, filed on Mar. 20, 2015 and Japanese Patent Application No. 2015-080801 filed on Apr. 10, 2015; the entire contents of which are incorporated herein by reference.

FIELD

One or more embodiments of the present invention relate to a vehicle control apparatus configured to detect that a user has approached a vehicle, and to allow the operation of a vehicle-mounted apparatus to welcome the user to the vehicle.

BACKGROUND

As disclosed in JP-A-2005-127050, a vehicle may have a welcome function in which it is detected that a user has approached a vehicle, and a vehicle-mounted apparatus is operated to welcome the user to the vehicle. For example, the welcome function is realized by use of a keyless entry system or a passive entry system.

Specifically, a vehicle-mounted transmitter mounted in the vehicle intermittently transmits a response request signal at predetermined intervals. When a user carrying a portable device approaches the vehicle, the portable device receives the response request signal, and responds with a response signal. When the vehicle-mounted transmitter mounted in the vehicle receives the response signal, for example, a welcome light provided in a side view mirror is turned on to illuminate the ground in the vicinity of a door, and welcomes the user to the vehicle.

The transmission of a response request signal from the vehicle-mounted transmitter is performed by a rolling method. For this reason, when the amount of stop time of an engine of the vehicle is increased, and the vehicle-mounted transmitter intermittently transmits a response request signal, electrical power is continuously consumed, and a battery of the vehicle, which is a power supply, is discharged, which is a problem.

In the system disclosed in JP-A-2001-98810, when the voltage of a battery is decreased to be lower than the voltage required to guarantee the driving of a door lock mechanism, the transmission of a response request signal from a vehicle-mounted transmitter is stopped. In the system disclosed in JP-A-10-297430, when an occupant sensor detects an occupant, the transmission of a response request signal from a vehicle-mounted transmitter is stopped. In the systems disclosed in JP-A-2001-98810 and JP-A-10-297430, when a portable device or a function stop switch provided in a vehicle is operated, the transmission of a response request signal from a vehicle-mounted transmitter is stopped. In the systems disclosed in JP-A-10-297430 and JP-A-2012-36669, a time slot, for which the transmission of a response request signal from a vehicle-mounted transmitter is stopped, is set.

In the system disclosed in JP-A-2008-38514, vehicle-mounted transmitters are respectively provided on the outsides of seats of a vehicle, and response request signals are transmitted according to an intermittent output control pattern in which the amount of time, for which two or more (but less than the total number of vehicle-mounted transmitters) of the vehicle-mounted transmitters transmit response request signals at the same time, is determined.

SUMMARY

In the related art, when a vehicle-mounted transmitter stops transmitting a response request signal immediately after a predetermined condition is established, for example, in a case where a lot of noise is present in the vicinity of a vehicle, even if a user carrying a portable device approaches the vehicle, the portable device may not be able to receive the response request signal transmitted from the vehicle-mounted transmitter. In this case, since the portable device does not respond with a response signal, the vehicle is not capable of detecting the approach of the user, and the operation of a vehicle-mounted apparatus to welcome the user is not allowed.

An object of one or more embodiments of the invention is to provide a vehicle control apparatus that is capable of easily detecting the approach of a user carrying a portable device, and reducing the consumption of electrical power.

According to an aspect of the invention, there is provided a vehicle control apparatus including: a vehicle-mounted transmitter which transmits a first response request signal; a vehicle-mounted receiver which receives a response signal which is transmitted from a portable device as a response to the first response request signal; and a controller which controls the vehicle-mounted transmitter and the vehicle-mounted receiver, and which allows an operation of a vehicle-mounted apparatus for welcoming a user carrying the portable device to a vehicle according to a reception state of the response signal received via the vehicle-mounted receiver. When the controller intermittently transmits the first response request signal at predetermined intervals via the vehicle-mounted transmitter, the controller determines whether or not condition set in advance is established. When the condition is established, the controller transmits a second response request signal, which is different from the first response request signal, via the vehicle-mounted transmitter instead of transmitting the first response request signal. According to whether or not the vehicle-mounted receiver receives a response signal which is transmitted from the portable device as a response to the second response request signal, the controller stops transmission of the second response request signal, and then the controller suppresses transmission of the first response request signal.

In this configuration, when the user carrying the portable device approaches the vehicle, in a case where the portable device may not be able to receive the first response request signal transmitted from the vehicle-mounted transmitter due to a lot of noise in the vicinity of the vehicle, but the conditions set in advance are established, the vehicle-mounted transmitter transmits the second response request signal different from the first response request signal. For this reason, the portable device receives the second response request signal, the vehicle-mounted receiver receives the response signal which is transmitted from the portable device as a response, and the vehicle control apparatus is capable of easily detecting the approach of the user. The controller transmits the second response request signal via the vehicle-mounted transmitter, and according to whether or not the vehicle-mounted receiver receives the response signal from the portable device, the controller stops the transmission of the second response request signal, and then suppresses the transmission of the first response request signal. For this reason, when it is not necessary to welcome the user to the vehicle, for example, in a case where the user carrying the portable device does not approach the vehicle, or in a case where the user has approached the vehicle with no intention of getting in the vehicle, it is possible to reduce the consumption of electrical power by suppressing the transmission of the first response request signal.

In the aspect of the invention, in a case where the vehicle-mounted receiver does not receive the response signal which is transmitted from the portable device as the response to the second response request signal, or in a case where the vehicle-mounted receiver receives the response signal but verification of an ID code included in the response signal is not established, the controller may suppress the transmission of the first response request signal according to the contents of the conditions. Alternatively, in a case where the vehicle-mounted receiver receives the response signal which is transmitted from the portable device as the response to the second response request signal and verification of an ID code included in the response signal is established, the controller may suppress the transmission of the first response request signal.

In the aspect of the invention, preferably, the second response request signal is a signal which is received by the portable device more easily than the first response request signal. For example, the second response request signal may be a signal having a transmission pattern, a data format, or signal strength different from that of the first response request signal. In other words, the second response request signal may be a signal having a shorter transmission interval, a longer data length, or stronger signal strength than that of the first response request signal.

In the aspect of the invention, the controller may suppress the transmission of the first response request signal by changing a transmission pattern of the first response request signal, or stopping the transmission of the first response request signal. The controller may increase the transmission interval of the first response request signal as a change in the transmission pattern. Alternatively, in a case where a plurality of the vehicle-mounted transmitters are provided, the controller may suppress the transmission of the first response request signal by reducing a number of vehicle-mounted transmitters which transmit the first response request signals.

In the aspect of the invention, the condition may include a condition that voltage of a battery, which is a power supply of the vehicle, is a threshold value or less. Alternatively, the condition may include a condition that the user carrying the portable device has no intention of getting in the vehicle.

In the aspect of the invention, when the condition is not established, the controller may continue to transmit the first response request signal. When the vehicle-mounted receiver receives the response signal which is transmitted from the portable device as the response to the second response request signal, the controller may stop the transmission of the second response request signal, and then re-start transmission of the first response request signal.

According to one or more embodiments of the invention, it is possible to provide a vehicle control apparatus capable of easily detecting the approach of a user carrying a portable device, and reducing the consumption of electrical power.

DETAILED DESCRIPTION

Figure 1:
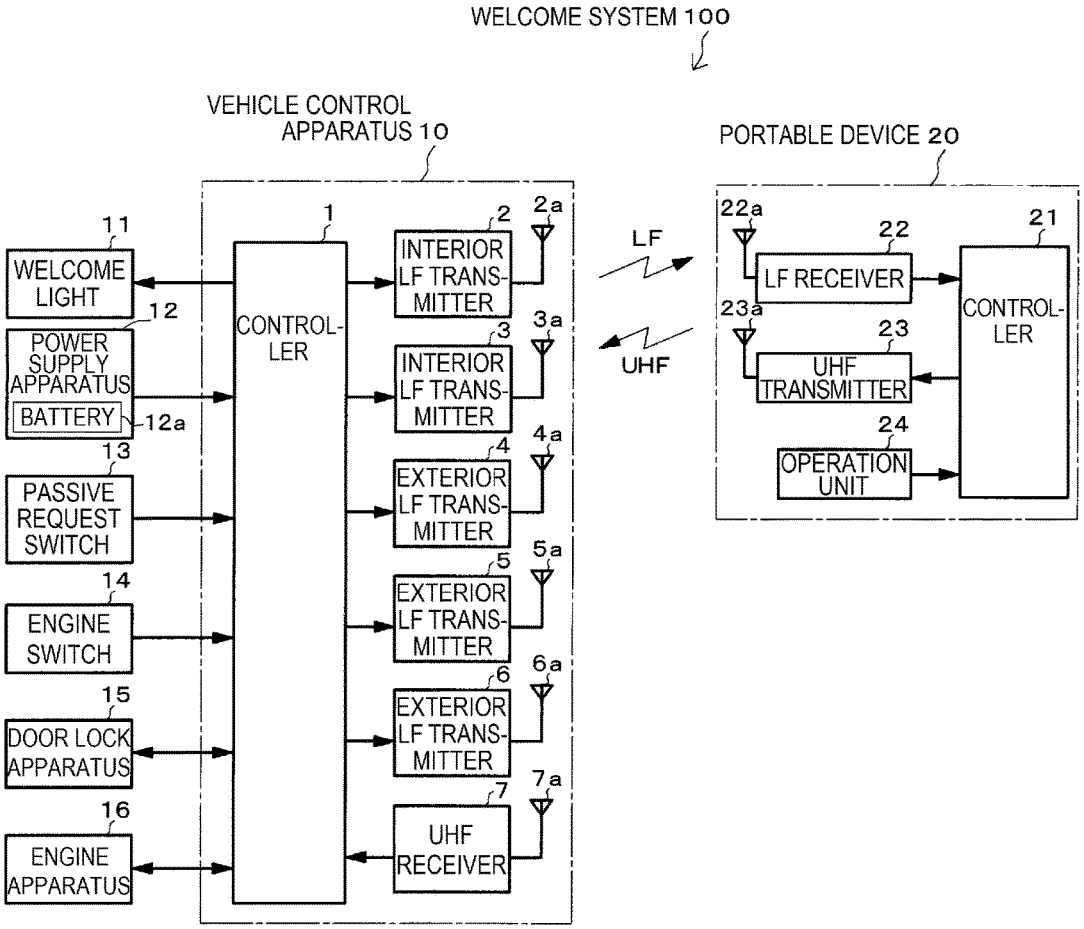
FIG. 1 is a block diagram illustrating the configuration of a welcome system.

In embodiments of the invention, numerous specific details are set forth in order to provide a thorough understanding of the invention. However, it will be apparent to one of ordinary skill in the art that the invention may be practiced without these specific details. In other instances, well-known features have not been described in detail to avoid obscuring the invention.

Hereinafter, one or more embodiments of the invention will be described with reference to the accompanying drawings. In the drawings, the same reference signs will be assigned to the same portions or the corresponding portions.

First, the configuration of the embodiments will be described with reference to FIGS. 1 and 2.

FIG. 1 is a block diagram illustrating the configuration of a welcome system 100. FIG. 2 is a view illustrating a vehicle 30 in which the welcome system 100 is mounted.

The welcome system 100 detects that a user has approached the vehicle 30 (refer to FIG. 2), and operates a vehicle-mounted apparatus to welcome the user to the vehicle 30. In this example, a welcome light 11 (refer to FIG. 1) is used as the vehicle-mounted apparatus welcoming a user to the vehicle 30. Specifically, when it is detected that a user has approached the vehicle 30, the welcome light 11 is turned on to illuminate the ground in the vicinity of the corresponding one of doors 31 and 32, thereby allowing the user to easily get in the vehicle.

The system 100 in FIG. 1 is a keyless entry system that locks and unlocks doors 31 to 33 via a switch operation in a state where a portable device 20 is in proximity to the vehicle 30, or a passive entry system that locks and unlocks the doors 31 to 33 when a user approaches or comes into contact with a door knob.

The vehicle control apparatus 10, the welcome light 11, a power supply apparatus 12, a passive request switch 13, an engine switch 14, a door lock apparatus 15, and an engine apparatus 16 are mounted in the vehicle 30. The portable device 20 is carried by a user of the vehicle 30.

The vehicle control apparatus 10 includes a controller 1; interior low frequency (LF) transmitters 2 and 3; exterior LF transmitters 4 to 6; and an ultra high frequency (UHF) receiver 7. The controller 1 includes a CPU, a memory, and the like.

The interior LF transmitters 2 and 3 and the exterior LF transmitters 4 to 6 are respectively include LF signal transmission circuits and antennas 2*a* to 6*a*. The respective antennas 2*a* and 3*a* of the interior LF transmitters 2 and 3 are provided in the vehicle interior of the vehicle 30 illustrated in FIG. 2. The interior LF transmitters 2 and 3 in the vehicle interior transmit LF signals so as to communicate with the portable device 20.

Figure 2:
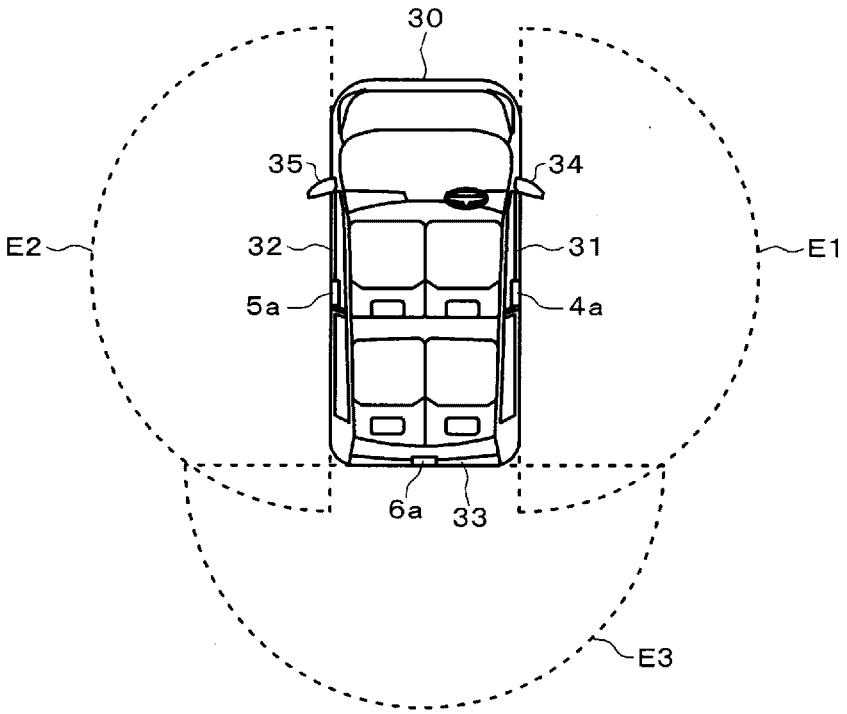
FIG. 2 is a view illustrating a vehicle in which the welcome system in FIG. 1 is mounted.

As illustrated in FIG. 2, the respective antennas 4*a* to 6*a* of the exterior LF transmitters 4 to 6 are provided on the vehicle exterior of the vehicle 30. Specifically, the antenna 4*a* of the exterior LF transmitter 4 is provided in the outside vicinity of the door 31 of a driver's seat of the vehicle 30. The antenna 5*a* of the exterior LF transmitter 5 is provided in the outside vicinity of the door 32 of a front passenger's seat of the vehicle 30. The antenna 6*a* of the exterior LF transmitter 6 is provided in the outside vicinity of the back door 33 of the vehicle 30. The exterior LF transmitters 4 to 6 transmit LF signals to the outside vicinity of the vehicle 30 in a polling method so as to communicate with the portable device 20. The exterior LF transmitters 4 to 6 are examples of a "vehicle-mounted transmitter" of one or more embodiments of the invention.

The UHF receiver 7 includes a UHF signal reception circuit and an antenna 7*a*, and receives a UHF signal transmitted from the portable device 20. The UHF receiver 7 is an example of a "vehicle-mounted receiver" of one or more embodiments of the invention.

The controller 1 controls the LF transmitters 2 to 6 and the UHF receiver 7 such that the LF transmitters 2 to 6 and the UHF receiver 7 transmit to and receive information from the portable device 20.

The portable device 20 is formed of an FOB key, and includes a controller 21; an LF receiver 22; a UHF transmitter 23; and an operation unit 24. The controller 21 includes a CPU, a memory, and the like.

The LF receiver 22 includes an LF signal reception circuit and an antenna 22*a*, and receives LF signals transmitted from the LF transmitters 2 to 6 of the vehicle control apparatus 10. The UHF transmitter 23 includes a UHF signal reception circuit and an antenna 23*a*, and transmits a UHF signal to the vehicle control apparatus 10. The operation unit 24 includes switches operated to lock and unlock the doors 31 to 33.

Welcome areas E1 to E3 illustrated in FIG. 2 are areas in which a user carrying the portable device 20 is welcomed to the vehicle 30. The vehicle control apparatus 10 is capable of communicating with the portable device 20 in any one of the welcome areas E1 to E3.

Specifically, the vehicle control apparatus 10 is capable of communicating with the portable device 20 in the welcome area E1 via the exterior LF transmitter 4 and the UHF receiver 7. The vehicle control apparatus 10 is capable of communicating with the portable device 20 in the welcome area E2 via the exterior LF transmitter 5 and the UHF receiver 7. The vehicle control apparatus 10 is capable of communicating with the portable device 20 in the welcome area E3 via the exterior LF transmitter 6 and the UHF receiver 7.

The vehicle control apparatus 10 communicates with the portable device 20, and ID codes are verified by both the vehicle control apparatus 10 and the portable device 20 in any one of the welcome areas E1 to E3. In a case where the verification is established, that is, in a case where both the ID codes are the same, the operation of a predetermined vehicle-mounted apparatus of the vehicle 30 is allowed.

As illustrated in FIG. 1, the vehicle control apparatus 10 is connected to vehicle-mounted apparatuses such as the welcome light 11, the power supply apparatus 12, the door lock apparatus 15, and the engine apparatus 16. The vehicle control apparatus 10 is connected to switches such as the passive request switch 13 and the engine switch 14.

The welcome light 11 includes a light emitting diode and the like, and is installed in each of side view mirrors 34 and 35 (refer to FIG. 2) of the vehicle 30. The power supply apparatus 12 includes a battery 12*a* which is a power supply of the vehicle 30. The power supply apparatus 12 manages electrical power of the battery 12*a*, and, for example, transmits information indicating the voltage of the battery 12*a* to the controller 1 of the vehicle control apparatus 10.

The passive request switch 13 is installed in the vicinity of a door knob on an outer surface of each of the doors 31 to 33 (refer to FIG. 2) of the vehicle 30. The engine switch 14 is installed in the vicinity of the driver's seat in the vehicle interior of the vehicle 30.

The door lock apparatus 15 includes mechanisms for respectively locking and unlocking the doors 31 to 33 of the vehicle 30, and a drive circuit of each of the mechanisms. The engine apparatus 16 includes a starter motor for driving an engine of the vehicle 30, and a drive circuit of the starter motor.

When a user carrying the portable device 20 operates the passive request switch 13, an operation signal is input to the controller 1. At this time, the controller 1 communicates with the portable device 20 via the LF transmitters 2 to 6 and the UHF receiver 7, and verifies the ID code. When the verification is established, the controller 1 controls the door lock apparatus 15 such that each of the doors 31 to 33 of the vehicle 30 is locked and unlocked.

In a case where a user operates the operation unit 24 of the portable device 20 in any one of the welcome areas E1 to E3, the controller 21 transmits a signal corresponding to the operation via the UHF transmitter 23. When the vehicle control apparatus 10 receives the signal corresponding to the operation of the operation unit 24 via the UHF receiver 7, the controller 1 verifies the ID code. When the verification is established, the controller 1 controls the door lock apparatus 15 such that the doors 31 to 33 of the vehicle 30 are locked and unlocked.

When a user carrying the portable device 20 operates the engine switch 14, an operation signal is input to the controller 1. At this time, the controller 1 communicates with the portable device 20, and verifies the ID code. When the verification is established, the controller 1 controls the engine apparatus 16 such that the engine of the vehicle 30 is started or stopped.

Hereinafter, operations of the vehicle control apparatus 10 and the portable device 20 in a first embodiment will be described with reference to FIGS. 3 to 14.

Figure 3:
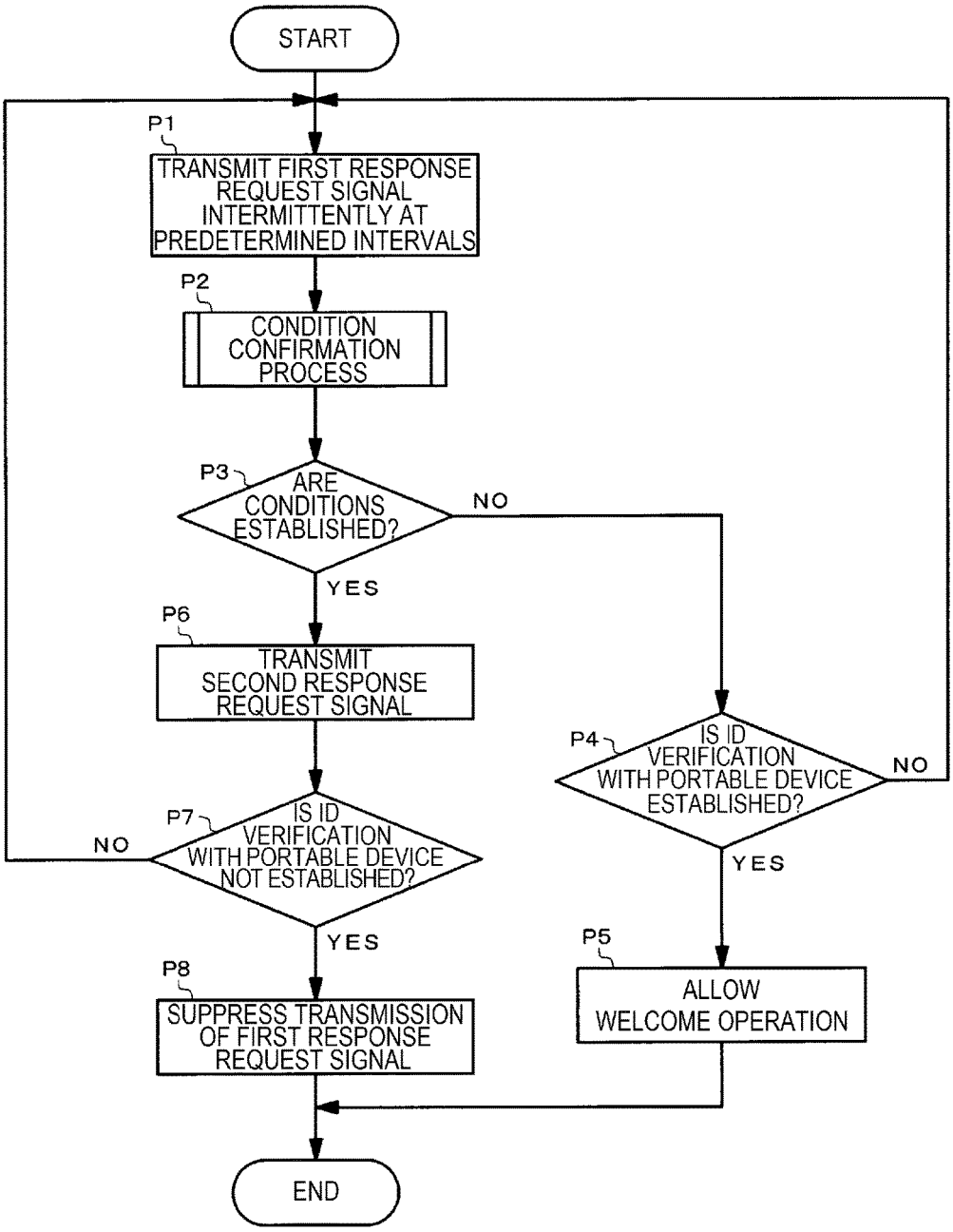
FIG. 3 is a flowchart illustrating the operation of a vehicle control apparatus in FIG. 1 according to a first embodiment.

FIG. 3 is a flowchart illustrating the operation of the vehicle control apparatus 10 in the first embodiment. For example, in a case where the vehicle 30 is stopped, and a user carrying the portable device 20 does not get in the vehicle 30, the controller 1 of the vehicle control apparatus 10 intermittently transmits first response request signals S1 at predetermined intervals via the exterior LF transmitters 4 to 6 (step P1 in FIG. 3).

Figure 5:
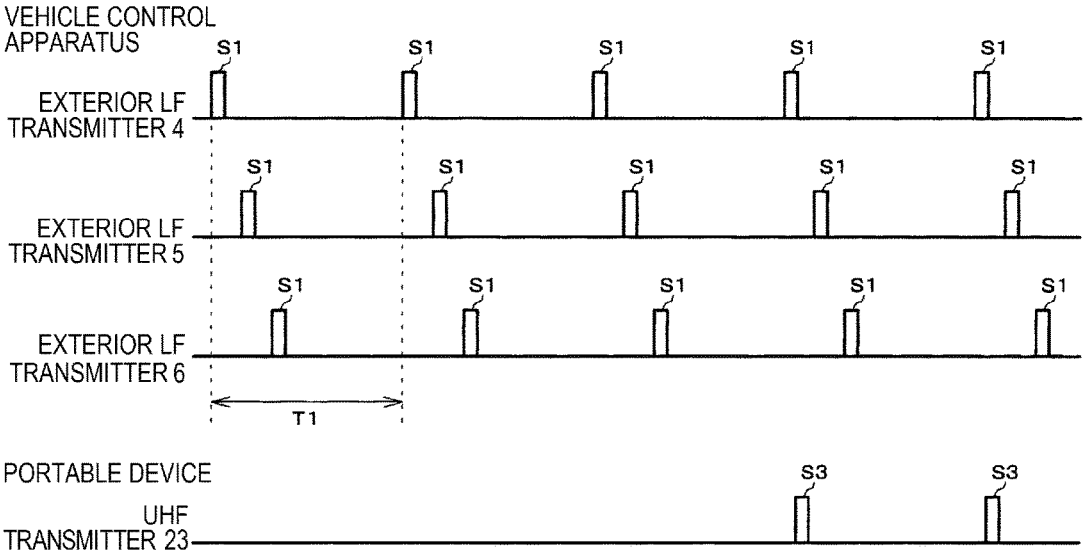
FIG. 5 is a chart illustrating an example of a transmission pattern of a first response request signal from an exterior LF transmitter and a response signal from a portable device in FIG. 1.

FIG. 5 is a chart illustrating an example of a transmission pattern of the first response request signals S1 from the exterior LF transmitters 4 to 6. For example, the exterior LF transmitter 4 transmits the first response request signal S1. After a predetermined interval has elapsed, the exterior LF transmitter 5 transmits the first response request signal S1. After a predetermined interval has elapsed, the exterior LF transmitter 6 transmits the first response request signal S1. The transmission interval between the exterior LF transmitter 4 and the exterior LF transmitter 5 may be the same or different from the transmission interval between the exterior LF transmitter 5 and the exterior LF transmitter 6. The exterior LF transmitters 4 to 6 have the same transmission period T1.

The controller 1 executes a condition confirmation process while the first response request signals S1 are transmitted by the exterior LF transmitters 4 to 6 (step P2 in FIG. 3).

Figure 4:
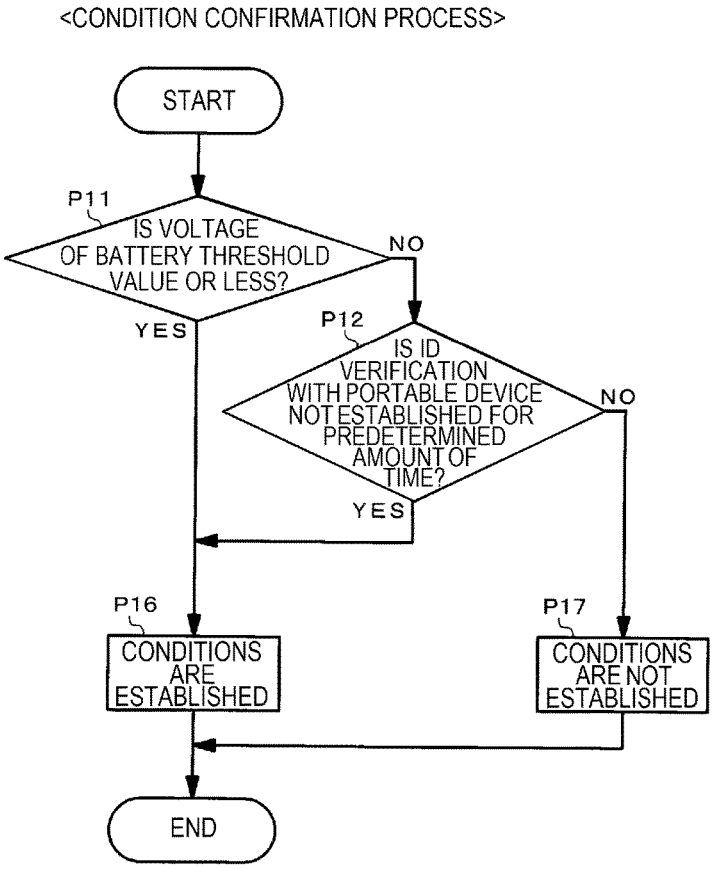
FIG. 4 is a flowchart illustrating a condition confirmation process in FIG. 3 in detail.

FIG. 4 is a flowchart illustrating the condition confirmation process in detail. The condition confirmation process is a process of detecting whether or not conditions set in advance are established. The conditions include the condition that the voltage of the battery 12*a* is a threshold value or less (step P11 in FIG. 4). The conditions also include the condition that it is determined that a user carrying the portable device 20 has no intention of getting in the vehicle (step P12 in FIG. 4).

Specifically, in step P11 illustrated in FIG. 4, the controller 1 determines whether or not the voltage of the battery 12*a* is the threshold value or less based on information received from the power supply apparatus 12.

In step P12 illustrated in FIG. 4, the controller 1 determines whether or not ID verification with the portable device 20 is established for the predetermined amount of time. The ID verification with the portable device 20 implies that the vehicle control apparatus 10 communicates with the portable device 20, and the ID codes respectively assigned to the vehicle control apparatus 10 and the portable device 20 are verified. For example, this verification is executed in a case where keyless entry or passive entry is performed, and engine authentication is performed. The engine authentication implies that an ID code is verified after the engine switch 14 is operated, and when the verification is established, the engine is started.

In step P12, in a case where the UHF receiver 7 does not receive a response signal S3 transmitted from the portable device 20 for a predetermined amount of time, the controller 1 determines that the ID verification with the portable device 20 is not established for a predetermined amount of time. Even if the UHF receiver 7 receives the response signal S3 for the predetermined amount of time, in a case where the ID code of the portable device 20 included in the response signal S3 is not the same as an ID code stored in the internal memory, the controller 1 determines that the ID verification with the portable device 20 is not established for the predetermined amount of time.

In a case where both determinations in steps P11 and P12 illustrated in FIG. 4 are NO, the controller 1 determines that the conditions are not established (step P17 in FIG. 4 and step P3 in FIG. 3: NO). In this case, the controller 1 confirms whether or not the ID verification with the portable device 20 is established (step P4 in FIG. 3).

For example, in a case where a user carrying the portable device 20 has approached any one of the welcome areas E1 to E3 of the vehicle 30, the LF receiver 22 of the portable device 20 receives the first response request signal S1 transmitted from any one of the exterior LF transmitters 4 to 6. The controller 21 of the portable device 20 responds with the response signal S3 via the UHF transmitter 23 so as to respond to the first response request signal S1. The response signal S3 includes the ID code assigned to the portable device 20.

When the UHF receiver 7 receives the response signal S3 which is transmitted from the portable device 20 as a response to the first response request signal S1, the controller 1 of the vehicle control apparatus 10 verifies the ID code of the portable device 20 included in the response signal S3 with the ID code previously stored in the internal memory. When both the ID codes are the same, the controller 1 determines that the ID verification with the portable device 20 is established (step P4 in FIG. 3: YES). That is, the vehicle control apparatus 10 detects that the user carrying the portable device 20 has approached the vehicle 30. In this case, the controller 1 allows the welcome light 11 to perform a welcome operation (step P5 in FIG. 3). Accordingly, the welcome light 11 is turned on to illuminate the ground in the vicinity of the corresponding one of the doors 31 and 32, and welcomes the user to the vehicle 30. The turning on and off of the welcome light 11 may be controlled by the controller 1 or another micro-computer.

In contrast, when a user carrying the portable device 20 is present outside of the welcome areas E1 to E3 or even in any one of the welcome areas E1 to E3, in a case where a lot of noise is present in the vicinity of the vehicle 30, the LF receiver 22 of the portable device 20 may not be able to receive the first response request signals S1 from the exterior LF transmitters 4 to 6 of the vehicle control apparatus 10. Accordingly, the response signal S3 is not transmitted from the UHF transmitter 23 of the portable device 20, and the UHF receiver 7 of the vehicle control apparatus 10 does not receive the response signal S3. As such, in a case where the UHF receiver 7 does not receive the response signal S3 corresponding to the first response request signal S1, the controller 1 determines that the ID verification with the portable device 20 is not established (step P4 in FIG. 3: NO). The controller 1 continues to intermittently transmit the first response request signals S1 at the predetermined intervals via the exterior LF transmitters 4 to 6 (step P1 in FIG. 3).

Even if the UHF receiver 7 receives the response signal S3 which is transmitted from the portable device 20 as a response to the first response request signal S1, in a case where the ID code of the portable device 20 included in the response signal S3 is not the same as the ID code stored in the internal memory, the controller 1 determines that the ID verification with the portable device 20 is not established (step P4 in FIG. 3: NO). Also, in this case, the controller 1 continues to intermittently transmit the first response request signals S1 at the predetermined intervals via the exterior LF transmitters 4 to 6 (step P1 in FIG. 3).

In contrast, in a case where a determination in either of step P11 or P12 is YES in the condition confirmation process illustrated in FIG. 4, the controller 1 determines that the conditions are established (step P16 in FIG. 4 and step P3 in FIG. 3: YES). In this case, the controller 1 transmits second response request signals S2 via the exterior LF transmitters 4 to 6 instead of transmitting the first response request signals S1 (step P6 in FIG. 3). The second response request signal S2 is a signal different from the first response request signal S1. Particularly, the second response request signal S2 is a signal which is received by the LF receiver 22 of the portable device 20 more easily than the first response request signal S1.

Figure 6:
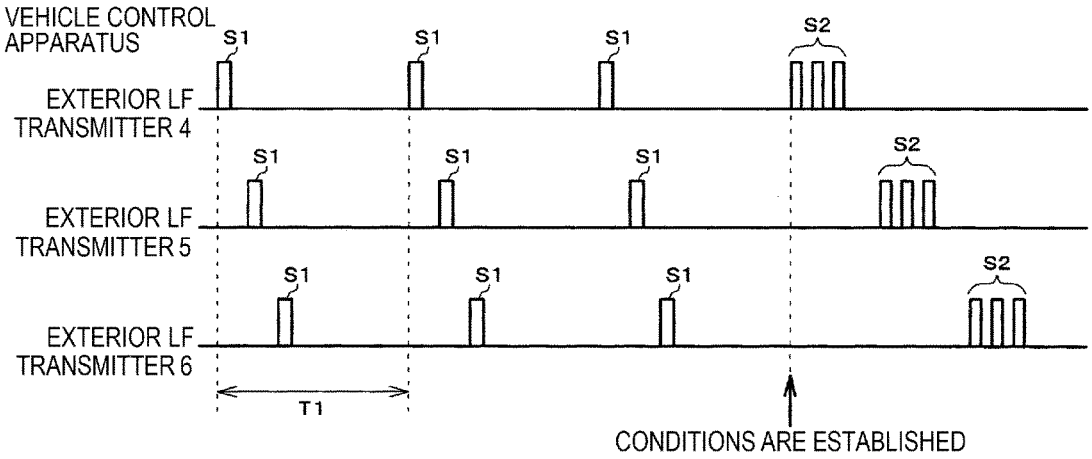
FIG. 6 is a chart illustrating an example of a transmission pattern of the first response request signal and a second response request signal from the exterior LF transmitter in FIG. 1.

FIG. 6 is a chart illustrating an example of a transmission pattern of the first response request signal S1 and the second response request signal S2. After the conditions are established, the exterior LF transmitters 4 to 6 transmit the second response request signals S2 which have a transmission pattern different from that of the first response request signal S1. Specifically, each of the exterior LF transmitters 4 to 6 repeatedly transmits a single first response request signal S1 in the sequence of the exterior LF transmitters 4 to 6. In contrast, each of the exterior LF transmitters 4 to 6 continuously transmits multiple (three) second response request signals S2 in the sequence of the exterior LF transmitters 4 to 6. The first response request signal S1 and the second response request signal S2 have the same data format. The continuous transmission of the second response request signals S2 from each of the exterior LF transmitters 4 to 6 may be repeated at predetermined intervals. Since the second response request signals S2 are continuously transmitted at short intervals in this manner, the second response request signal S2 is more easily received by the LF receiver 22 of the portable device 20, and the noise immunity is improved.

As illustrated in FIGS. 7 to 10, after the conditions are established, each of the exterior LF transmitters 4 to 6 may transmit either of another second response request signal S2' or S2" different from the first response request signal S1.

Figure 7:
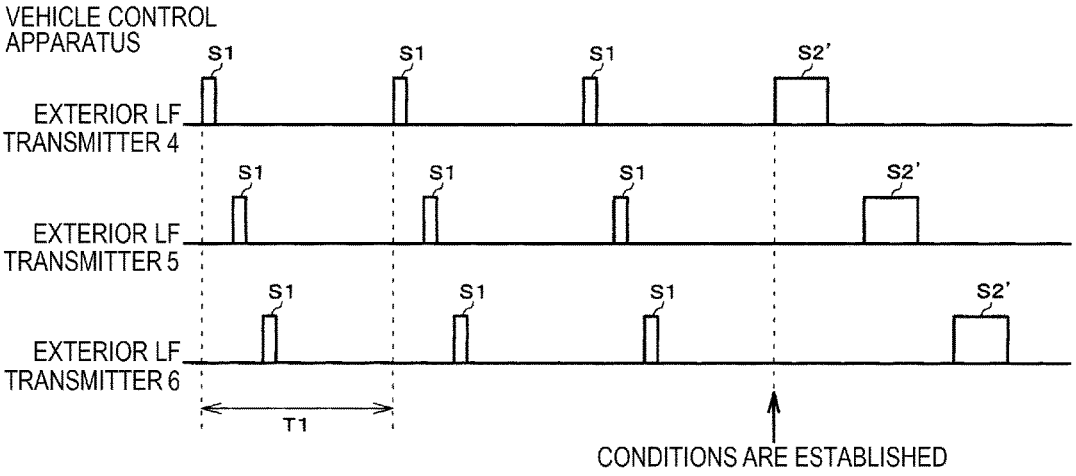
FIG. 7 is a chart illustrating another example of a transmission pattern of the first response request signal and the second response request signal from the exterior LF transmitter in FIG. 1.
Figure 8:
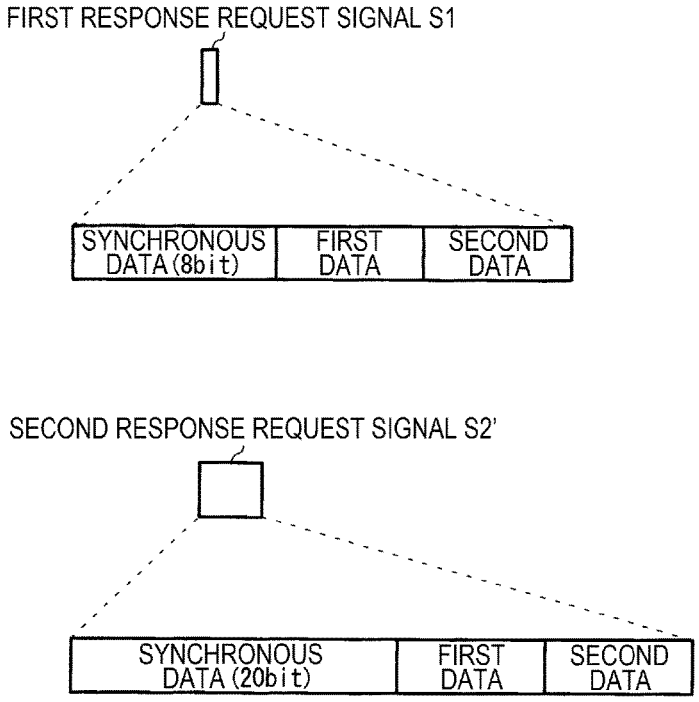
FIG. 8 is a chart illustrating an example of data formats of the first response request signal and the second response request signal in the example illustrated in FIG. 7.

In the example illustrated in FIG. 7, after the conditions are established, each of the exterior LF transmitters 4 to 6 transmits the second response request signal S2' having a data format different from that of the first response request signal S1. Specifically, as illustrated in FIG. 8, the first response request signal S1 has a data format in which a leading data block includes 8-bit synchronous data, a data block subsequent to the leading data block includes first data indicating vehicle information or the like, and a data block subsequent to the data block includes second data indicating authentication information or the like. In contrast, the second response request signal S2' has a data format in which a leading data block includes 20-bit synchronous data, a data block subsequent to the leading data block includes the first data, and a data block subsequent to the data block includes the second data. The transmission of the second response request signals S2' from each of the exterior LF transmitters 4 to 6 may be repeated at predetermined intervals. Since the synchronous data length of the second response request signal S2' is increased in this manner, the second response request signal S2' is more easily received by the LF receiver 22 of the portable device 20, and the noise immunity is improved.

Figure 9:
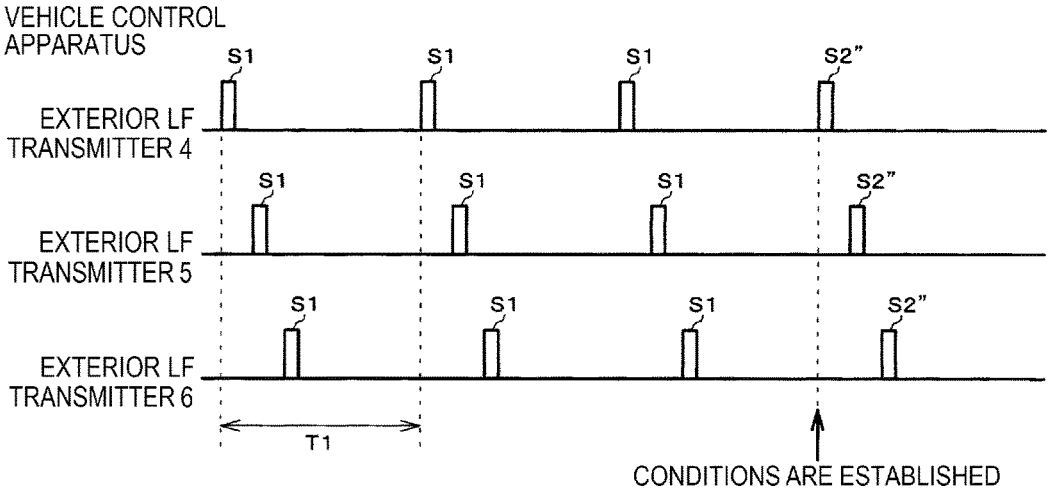
FIG. 9 is a chart illustrating still another example of a transmission pattern of the first response request signal and the second response request signal from the exterior LF transmitter in FIG. 1.
Figure 10:
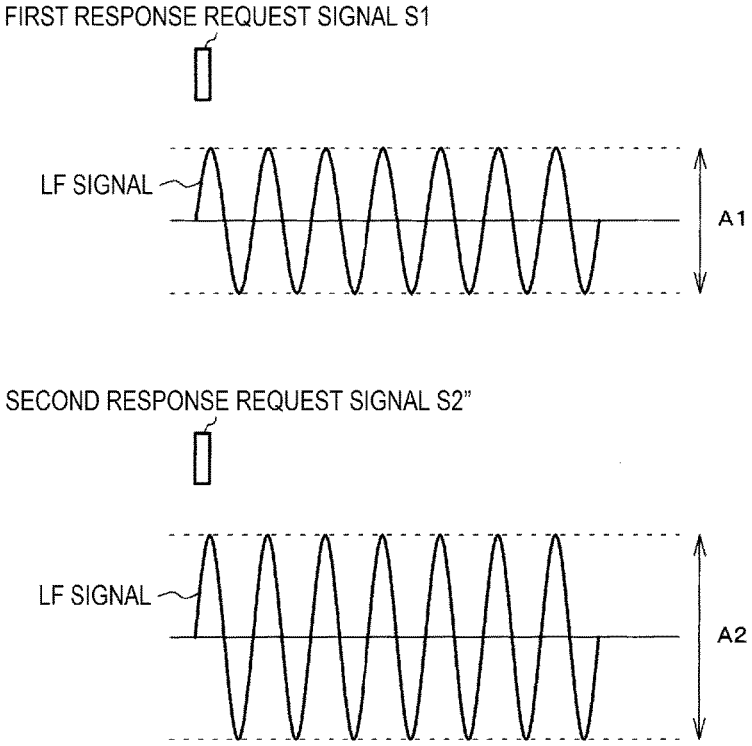
FIG. 10 is a graph illustrating an example of the strengths of the first response request signal and the second response request signal in the example illustrated in FIG. 9.

In the example illustrated in FIG. 9, after the conditions are established, each of the exterior LF transmitters 4 to 6 transmits the second response request signal S2" having LF signal strength different from that of the first response request signal S1. Specifically, as illustrated in FIG. 10, an amplitude A1 of the sinusoidal wave of the first response request signal S1 is set to be greater than an amplitude A2 of the sinusoidal wave of the second response request signal S2" such that the strength of the second response request signal S2" is higher than that of the first response request signal S1". The transmission of the second response request signals S2" from each of the exterior LF transmitters 4 to 6 may be repeated at predetermined intervals. Since the strength of the second response request signal S2" is increased in this manner, the second response request signal S2" is more easily received by the LF receiver 22 of the portable device 20, and the noise immunity is improved.

The controller 1 confirms whether or not the ID verification with the portable device 20 is established while the second response request signals S2 are transmitted by the exterior LF transmitters 4 to 6 (step P7 in FIG. 3).

Figure 11:
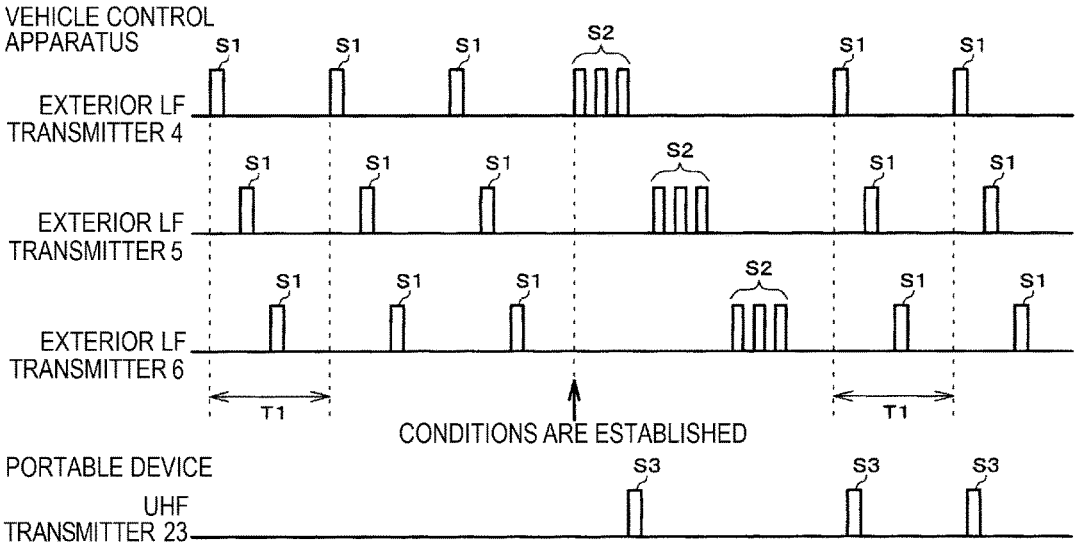
FIG. 11 is a chart illustrating an example of a transmission pattern of the first response request signal, the second response request signal, and a response signal in a case where the vehicle control apparatus in FIG. 1 receives the response signal corresponding to the second response request signal.

When the LF receiver 22 of the portable device 20 receives the second response request signal S2 transmitted from any one of the exterior LF transmitters 4 to 6, as illustrated in FIG. 11, the controller 21 responds with the response signal S3 via the UHF transmitter 23 so as to respond to the second response request signal S2. When the UHF receiver 7 of the vehicle control apparatus 10 receives the response signal S3, the controller 1 verifies the ID code of the portable device 20 included in the response signal S3 with the ID code stored in the internal memory. When both the ID codes are the same, the controller 1 determines that the ID verification with the portable device 20 is established (step P7 in FIG. 3: NO). In this case, after the controller 1 stops the transmission of the second response request signals S2 from the exterior LF transmitters 4 to 6, the controller 1 re-starts transmission of the first response request signals S1 via the exterior LF transmitters 4 to 6 (step P1 in FIG. 3).

In contrast, for example, in a case where the LF receiver 22 of the portable device 20 does not receive the second response request signals S2 transmitted from the exterior LF transmitters 4 to 6, the response signal S3 is not transmitted from the UHF transmitter 23 of the portable device 20, and the UHF receiver 7 of the vehicle control apparatus 10 does not receive the response signal S3. As such, in a case where the UHF receiver 7 does not receive the response signal S3 corresponding to the second response request signal S2, the controller 1 determines that the ID verification with the portable device 20 is not established (step P7 in FIG. 3: YES).

Even if the UHF receiver 7 receives the response signal S3 which is transmitted from the portable device 20 corresponding to the second response request signal S2, in a case where the ID code of the portable device 20 included in the response signal S3 is not the same as the ID code stored in the internal memory, the controller 1 determines that the ID verification with the portable device 20 is not established (step P7 in FIG. 3: YES).

In a case where the ID verification with the portable device 20 is not established (step P7 in FIG. 3: YES), which indicates that a user does not approach the vehicle 30, or the ID code of the portable device 20 is verified as being incorrect, after the controller 1 stops the transmission of the second response request signals S2 from the exterior LF transmitters 4 to 6, the controller 1 suppresses the transmission of the first response request signals S1 from the exterior LF transmitters 4 to 6 (step P8 in FIG. 3).

Figure 12:
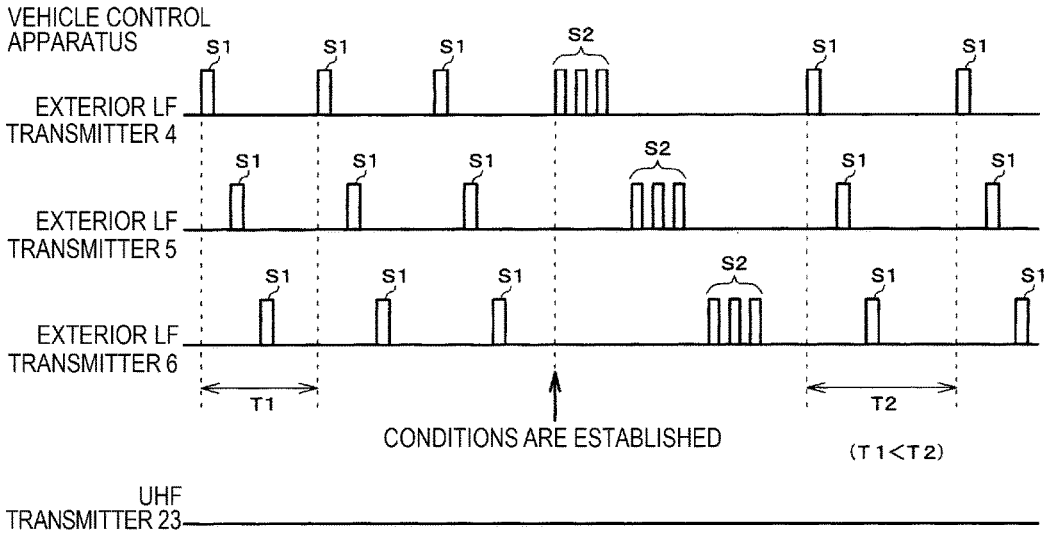
FIG. 12 is a chart illustrating an example of a transmission pattern of the first response request signal and the second response request signal in a case where the vehicle control apparatus in FIG. 1 does not receive a response signal corresponding to the second response request signal.

FIG. 12 is a chart illustrating an example of a transmission pattern of the first response request signal S1 and the second response request signal S2 in a case where the vehicle control apparatus 10 does not receive a response signal corresponding to the second response request signal S2. The transmission pattern of the first response request signal S1 before the transmission of the second response request signal S2 is different from that of the first response request signal S1 after the transmission of the second response request signal S2. Specifically, a transmission period T2 of the first response request signal S1, which is transmitted from each of the exterior LF transmitters 4 to 6 after the transmission of the second response request signal S2 is stopped, is longer than a transmission period T1 of the first response request signal S1 which is transmitted from each of the exterior LF transmitters 4 to 6 before the transmission of the second response request signal S2 (T1<T2). In this manner, after the transmission of the second response request signal S2 is stopped, the transmission of the first response request signals S1 from the exterior LF transmitters 4 to 6 is suppressed.

Figure 13:
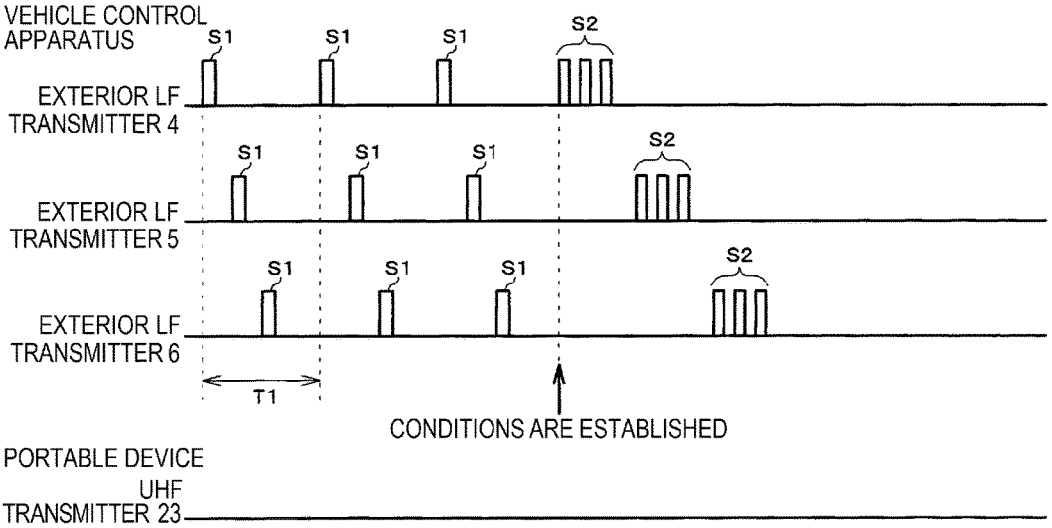
FIG. 13 is a chart illustrating another example of a transmission pattern of the first response request signal and the second response request signal in a case where the vehicle control apparatus in FIG. 1 does not receive a response signal corresponding to the second response request signal.
Figure 14:
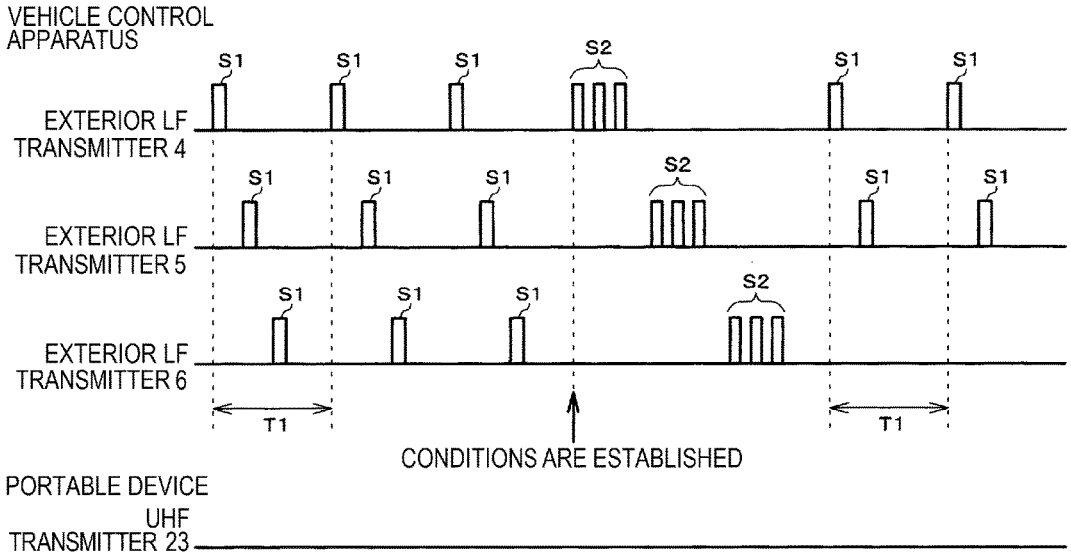
FIG. 14 is a chart illustrating still another example of a transmission pattern of the first response request signal and the second response request signal in a case where the vehicle control apparatus in FIG. 1 does not receive a response signal corresponding to the second response request signal.

Alternatively, the transmission of the first response request signal S1 may be suppressed by the method illustrated in FIG. 13 or 14.

In the example illustrated in FIG. 13, after the transmission of the second response request signals S2 from the exterior LF transmitters 4 to 6 is stopped, the transmission of the first response request signal S1 is stopped. That is, after the transmission of the second response request signals S2 is stopped, the operation of the exterior LF transmitters 4 to 6 is stopped.

In the example illustrated in FIG. 14, the number of exterior LF transmitters 4 to 6, which transmit the first response request signal S1 before the transmission of the second response request signal S2, is different from the number of exterior LF transmitters 4 to 6 which transmit the first response request signal S1 after the transmission of the second response request signal S2. Specifically, before the second response request signal S2 is transmitted, the three exterior LF transmitters 4 to 6 transmit the first response request signals S1. In contrast, after the transmission of the second response request signal S2 is stopped, the two exterior LF transmitters 4 and 5 transmit the first response request signals S1.

The reason of the re-start transmission of the first response request signals S1 from the exterior LF transmitters 4 and 5 and the stopping of the transmission of the first response request signal S1 from the exterior LF transmitter 6 is that the installation positions of the respective antennas 4*a* to 6*a* of the exterior LF transmitters 4 to 6 have been taken into consideration. That is, as illustrated in FIG. 2, in order to get in the vehicle 30, a user is highly likely to approach the door 31 of the driver's seat where the antenna 4*a* of the exterior LF transmitter 4 is provided, or the door 32 of the front passenger's seat where the antenna 5*a* of the exterior LF transmitter 5 is provided rather than approaching the back door 33 where the antenna 6*a* of the exterior LF transmitter 6 is provided. For this reason, the controller 1 stops the operation of the exterior LF transmitter 6 having a lower probability of communication with the portable device 20 than the exterior LF transmitters 4 and 5. The transmission of the first response request signals S1 from the exterior LF transmitters 4 to 6 is suppressed by reducing the number of exterior LF transmitters 4 to 6 transmitting the first response request signal S1 after the transmission of the second response request signal S2 is stopped.

As described above, in a case where a user carrying the portable device 20 approaches the vehicle 30, and, for example, a lot of noise is present in the vicinity of the vehicle 30, the LF receiver 22 of the portable device 20 may not be able to receive the first response request signals S1 transmitted from the exterior LF transmitters 4 to 6 of the vehicle control apparatus 10.

Meanwhile, when the vehicle control apparatus 10 in the first embodiment receives the first response request signals S1 from the exterior LF transmitters 4 to 6, and the conditions set in advance are established, the vehicle control apparatus 10 transmits the second response request signals S2, which are different from the first response request signal S1, via the exterior LF transmitters 4 to 6. For this reason, the LF receiver 22 of the portable device 20 receives the second response request signal S2, the UHF receiver 7 of the vehicle control apparatus 10 receives the response signal S3 which is transmitted from the UHF transmitter 23 of the portable device 20 as a response, and the controller 1 of the vehicle control apparatus 10 is capable of easily detecting the approach of the user. When the approach of the user is detected, the welcome light 11 is turned on, and is capable of welcoming the user to the vehicle 30.

In the embodiment, in a case where the exterior LF transmitters 4 to 6 of the vehicle control apparatus 10 transmit the second response request signals S2, but the UHF receiver 7 does not receive the response signal S3 from the portable device 20, the transmission of the first response request signal S1 is suppressed after the transmission of the second response request signal S2 is stopped. In a case where the UHF receiver 7 receives the response signal S3 corresponding to the second response request signal S2, but the verification of the ID codes is not established due to the ID code of the portable device 20 included in the response signal S3 not being the same as the ID code stored in the vehicle control apparatus 10, the transmission of the first response request signal S1 is suppressed after the transmission of the second response request signal S2 is stopped. For this reason, when it is not necessary to welcome a user, for example, in a case where a user carrying the portable device 20 does not approach the vehicle 30, or in a case where the user has approached the vehicle 30 with no intention of getting in the vehicle, it is possible to reduce the consumption of electrical power by suppressing the transmission of the first response request signal S1.

In the embodiment, since the second response request signal S2 has a shorter transmission interval, the second response request signal S2' has a longer data length, and the second response request signal S2" has stronger signal strength than the first response request signal S1, the second response request signals S2, S2', and S2" are signals which are received by the LF receiver 22 of the portable device 20 more easily than the first response request signal S1. For this reason, the LF receiver 22 of the portable device 20 easily receives the second response request signals S2, S2', and S2", the UHF receiver 7 of the vehicle control apparatus 10 receives the response signal S3 transmitted from the UHF transmitter 23 of the portable device 20 as a response, and the controller 1 of the vehicle control apparatus 10 is capable of more accurately detecting the approach of a user.

In the embodiment, in a case where the vehicle control apparatus 10 does not receive the response signal S3 from the portable device 20, or in a case where the verification of the ID codes between the portable device 20 and the vehicle control apparatus 10 is not established, the transmission of the first response request signal S1 is suppressed by increasing the transmission interval of the first response request signal S1, reducing the number of exterior LF transmitters 4 to 6 transmitting the first response request signals S1, or stopping the transmission of the first response request signal S1, after the transmission of the second response request signal S2 is stopped. For this reason, it is possible to reduce the consumption of electrical power by decreasing an average value of current flowing through the exterior LF transmitters 4 to 6.

In the embodiment, conditions for changing a transmission signal of each of the exterior LF transmitters 4 to 6 from the first response request signal S1 to the second response request signal S2 include the condition that the voltage of the battery 12*a* is the threshold value or less. For this reason, even when the voltage of the battery 12*a* is decreased, the approach of a user carrying the portable device 20 can be easily detected. In a case where the second response request signal S2 is transmitted, but the UHF receiver 7 does not receive the response signal S3 from the portable device 20, the transmission of the first response request signal S1 is suppressed. As a result, it is possible to suppress the consumption of electrical power of the battery 12*a*.

In the embodiment, the conditions for changing a transmission signal of each of the exterior LF transmitters 4 to 6 from the first response request signal S1 to the second response request signal S2 include the condition that a user carrying the portable device 20 is determined to have no intention of getting in the vehicle for the predetermined amount of time as described in step P12 illustrated in FIG. 4. For this reason, the vehicle control apparatus 10 is capable of confirming that the user carrying the portable device 20 has approached the vehicle 30, and whether or not the user intends to get in the vehicle 30. In a case where the condition that a user is determined to have no intention of getting in the vehicle is established, and the second response request signal S2 is transmitted, but the UHF receiver 7 does not receive the response signal S3 from the portable device 20, the transmission of the first response request signal S1 is suppressed. As a result, it is possible to suppress the unnecessary consumption of electrical power.

In the embodiment, when the conditions are not established, and the ID verification with the portable device 20 is not established, the vehicle control apparatus 10 continues to transmit the first response request signal S1. When the UHF receiver 7 receives the response signal S3 which is transmitted from the portable device 20 as a response to the second response request signal S2, and the verification of the ID codes between the portable device 20 and the vehicle control apparatus 10 is established, transmission of the first response request signal S1 is re-started after the transmission of the second response request signal S2 is stopped. For this reason, in a case where the consumption of electrical power by the transmission of the second response request signals S2 is greater than that by the transmission of the first response request signals S1 from the exterior LF transmitters 4 to 6, it is possible to reduce the consumption of electrical power by changing a transmission signal from the second response request signal S2 back to the first response request signal S1. Since a transmission signal from each of the exterior LF transmitters 4 to 6 is changed back to the first response request signal S1, the system is capable of returning to a typical detection mode for detecting the portable device 20.

Hereinafter, the operation of the vehicle control apparatus 10 and the portable device 20 in a second embodiment will be described with reference to FIGS. 15 and 16.

Figure 15:
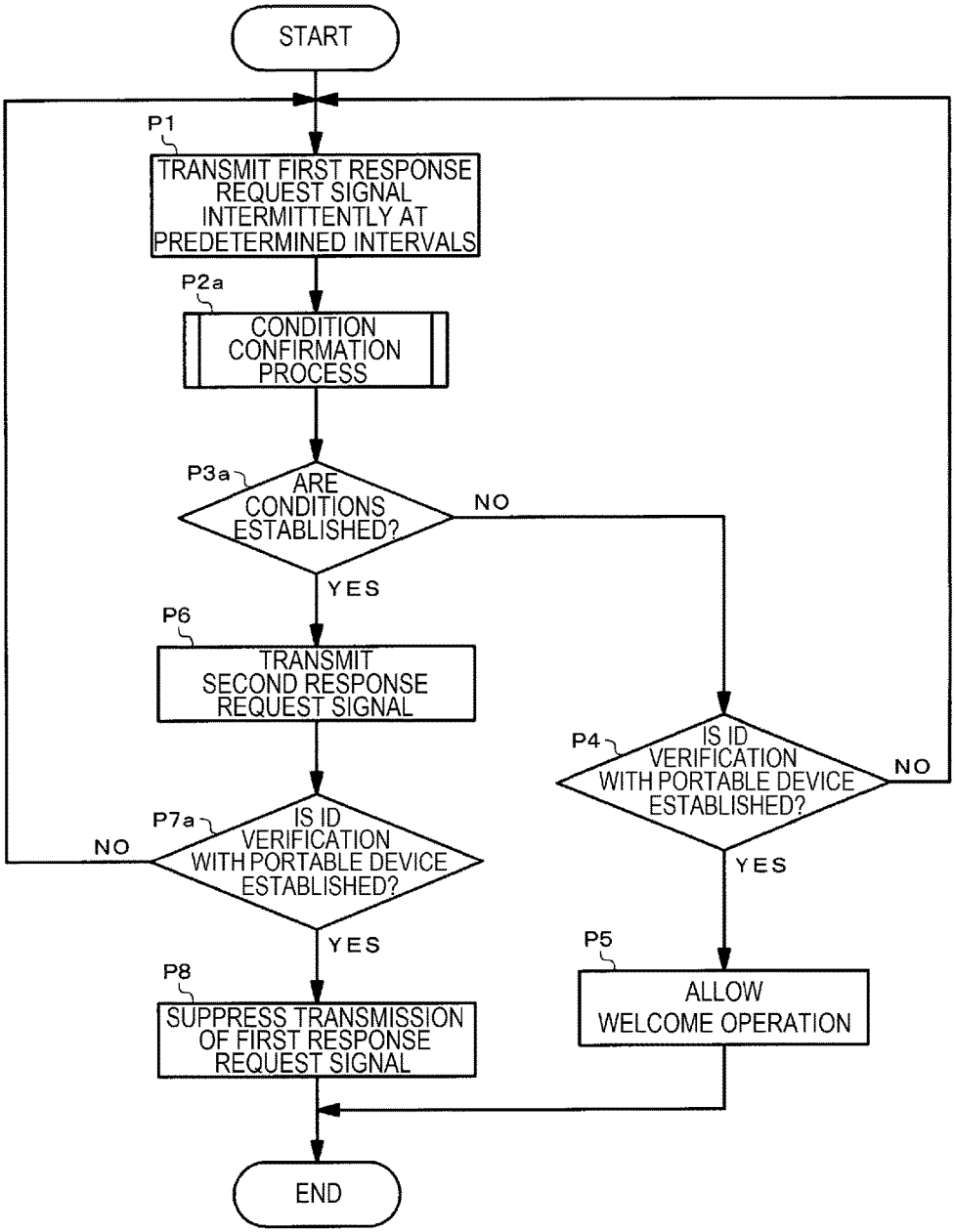
FIG. 15 is a flowchart illustrating the operation of the vehicle control apparatus in a second embodiment.

FIG. 15 is a flowchart illustrating the operation of the vehicle control apparatus 10 in the second embodiment. In the second embodiment, the controller 1 executes a condition confirmation process illustrated in FIG. 16 while the first response request signals S1 are transmitted by the exterior LF transmitters 4 to 6 (step P2*a* in FIG. 15).

Figure 16:
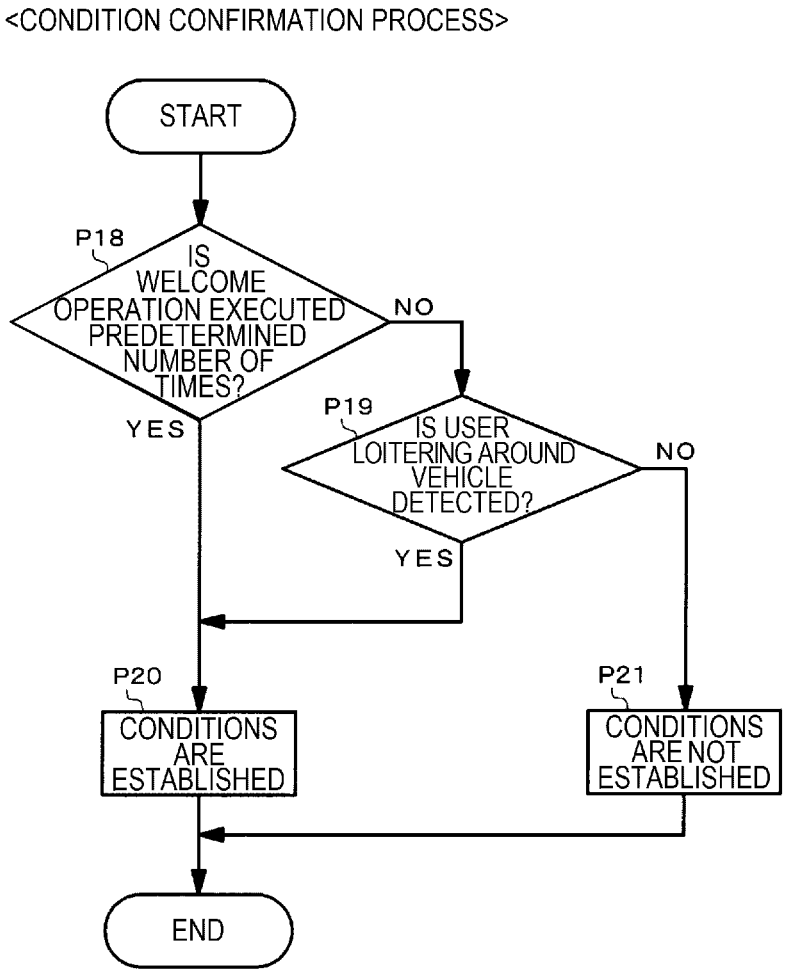
FIG. 16 is a flowchart illustrating a condition confirmation process in FIG. 15 in detail.

The condition confirmation process in FIG. 16 includes the condition that a user carrying the portable device 20 approaches the vehicle 30, but is determined to have no intention of getting in the vehicle (steps P18 and P19 in FIG. 16).

Specifically, in step P18 illustrated in FIG. 16, the controller 1 determines whether or not a welcome operation is performed a predetermined number of times. In this example, the welcome operation is the turning on of the welcome light 11.

In step P19 illustrated in FIG. 16, the controller 1 determines whether or not a user loitering around the vehicle 30 is detected. For example, in a case where a user carrying the portable device 20 stays in any one of the welcome areas E1 to E3 for a predetermined amount of time without operating the operation unit 24 of the portable device 20 or the passive request switch 13, it is determined that the user has no intention of getting in the vehicle, and the controller 1 detects that the user loiters around the vehicle 30. Additionally, for example, in a case where a user leaves the portable device 20 in any one of the welcome areas E1 to E3 for a predetermined amount of time, it is determined that the user has no intention of getting in the vehicle, and the controller 1 detects that the user loiters around the vehicle 30.

In a case where both determinations in steps P18 and P19 illustrated in FIG. 16 are NO, the controller 1 determines that the conditions are not established (step P21 in FIG. 16 and step P3*a* in FIG. 15: NO). In this case, the controller 1 confirms whether or not the ID verification with the portable device 20 is established (step P4 in FIG. 15). As described above, after the controller 1 receives the response signal S3 which is transmitted from the portable device 20 as a response to the first response request signal S1, the controller 1 verifies the ID code of the portable device 20 included in the response signal S3 with the ID code stored in the internal memory. When both the ID codes are the same, the controller 1 determines that the ID verification with the portable device 20 is established (step P4 in FIG. 15: YES), and allows a welcome operation (step P5 in FIG. 15).

In contrast, in a case where a determination in either of step P18 or P19 illustrated in FIG. 16 is YES, the controller 1 determines that the conditions are established (step P20 in FIG. 16 and step P3*a* in FIG. 15: YES). In this case, the controller 1 transmits the second response request signals S2 via the exterior LF transmitters 4 to 6 instead of transmitting the first response request signal S1 (step P6 in FIG. 15).

The controller 1 confirms whether or not the ID verification with the portable device 20 is established while the second response request signals S2 are transmitted by the exterior LF transmitters 4 to 6 (step P7*a* in FIG. 15). In a case where the controller does not receive the response signal S3 corresponding to the second response request signal S2, or in a case where the controller 1 receives the response signal S3, but the ID code of the portable device 20 is not the same as the ID code stored in the internal memory, the controller 1 determines that the ID verification with the portable device 20 is not established (step P7*a* in FIG. 15: NO). In this case, after the controller 1 stops the transmission of the second response request signals S2 from the exterior LF transmitters 4 to 6, the controller 1 re-starts transmission of the first response request signals S1 via the exterior LF transmitters 4 to 6 (step P1 in FIG. 15).

In contrast, when the controller 1 receives the response signal S3 corresponding to the second response request signal S2, and the ID code of the portable device 20 included in the response signal S3 is the same as the ID code stored in the internal memory, the controller 1 determines that the ID verification with the portable device 20 is established (step P7*a* in FIG. 15: YES). In this case, since it is determined that a user carrying the portable device 20 has no intention of getting in the vehicle, after the controller 1 stops the transmission of the second response request signals S2 from the exterior LF transmitters 4 to 6, the controller 1 suppresses the transmission of the first response request signals S1 from the exterior LF transmitters 4 to 6 (step P8 in FIG. 15).

When the condition that a user is confirmed to have no intention of getting in the vehicle is established, the vehicle control apparatus 10 in the second embodiment transmits the second response request signals S2 via the exterior LF transmitters 4 to 6 instead of transmitting the first response request signal S1. For this reason, the portable device 20 receives the second response request signal S2, the vehicle control apparatus 10 receives the response signal S3 which is transmitted from the portable device 20 as a response, and the vehicle control apparatus 10 is capable of easily detecting the proximity of the portable device 20. When the ID verification between the vehicle control apparatus 10 and the portable device 20 is established (that is, when it confirmed that the response signal S3 is received, and the ID codes are the same), a welcome operation is not allowed, and after the transmission of the second response request signal S2 is stopped, the transmission of the first response request signal S1 is suppressed. That is, when it is not necessary to welcome a user, for example, in a case where the portable device 20 is in proximity to the vehicle 30, but a user has no intention of getting in the vehicle, a welcome operation is not allowed, and the transmission of the first response request signal S1 is suppressed. As a result, it is possible to reduce the consumption of electrical power.

Figure 17:
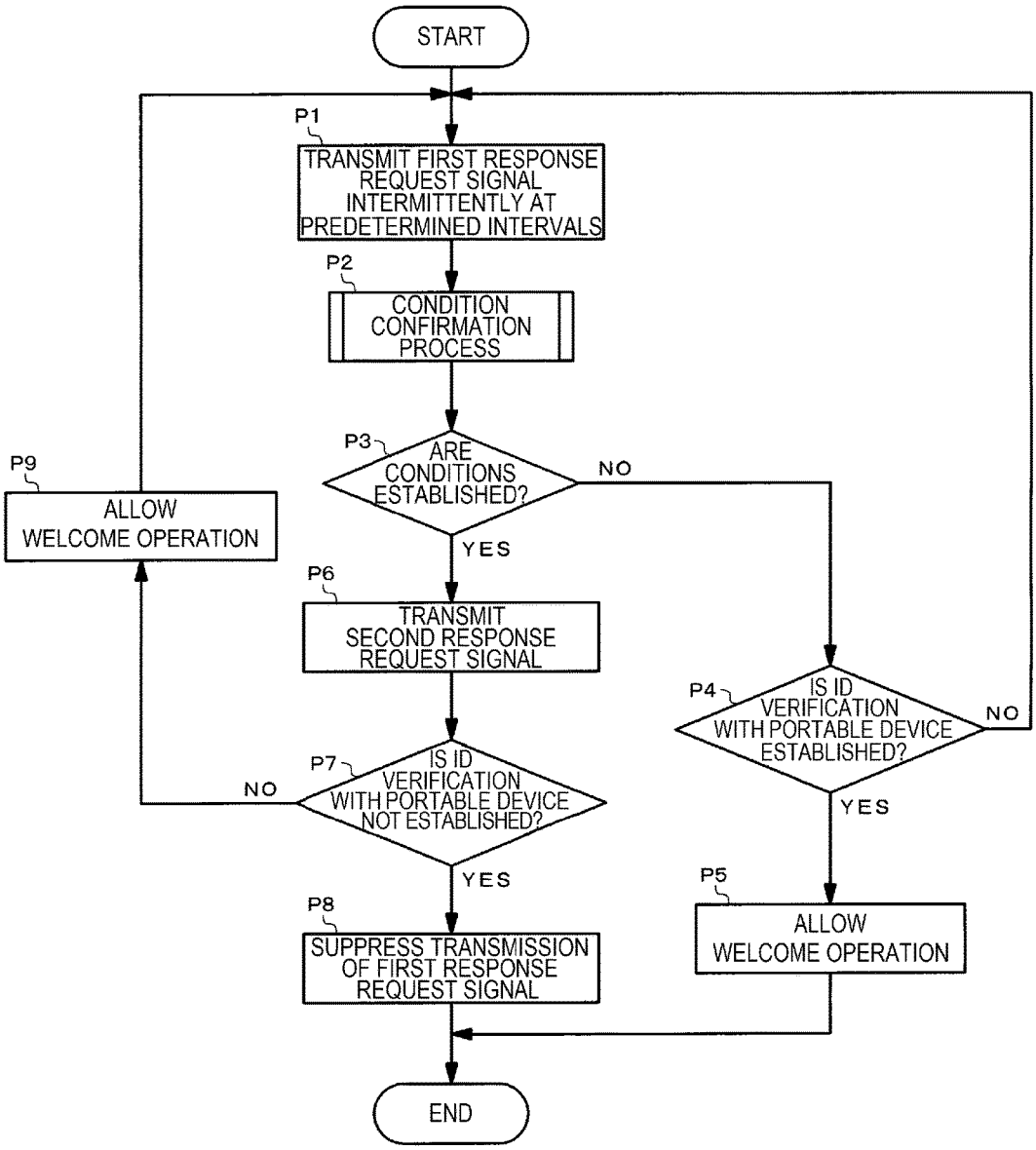
FIG. 17 is a flowchart illustrating the operation of the vehicle control apparatus in a third embodiment.

The invention is capable of adopting various embodiments other than the aforementioned embodiments. In the first embodiment illustrated in FIG. 3, in a case where the second response request signal S2 is transmitted, and then the ID verification with the portable device 20 is established, the controller 1 of the vehicle control apparatus 10 stops the transmission of the second response request signal S2, and re-starts transmission of the first response request signal S1; however, the invention is not limited to the example described in the first embodiment. In addition, as described in a third embodiment illustrated in FIG. 17, in a case where the second response request signal S2 is transmitted, and then the ID verification with the portable device 20 is established (step P7 in FIG. 17: NO), after the controller 1 allows a welcome operation (step P9 in FIG. 17), the controller 1 may re-start transmission of the first response request signal S1 in step P1 illustrated in FIG. 17.

In the aforementioned embodiments, the conditions for switching a transmission signal from each of the exterior LF transmitters 4 to 6 from the first response request signal S1 to the second response request signal S2 are described in steps P11 and P12 illustrated in FIG. 4, or in steps P18 and P19 illustrated in FIG. 16; however, the invention is not limited to the examples described in the aforementioned embodiments, and other determination elements may be set as the conditions in advance. A combination of multiple determination elements may be set as the conditions. In a case where any one, two or more, or all of the determination elements are YES, it may be determined that the conditions are established.

In the aforementioned embodiments, when it is detected that a user carrying the portable device 20 approaches the vehicle 30, the welcome light 11 is turned on to welcome the user; however, the invention is not limited to the example described in the aforementioned embodiments. Alternatively, a user may be welcomed to the vehicle by other methods, for example, any one of the doors 31 to 33 of the vehicle 30 is unlocked, the engine is started, or an air conditioner is driven.

In the aforementioned embodiments, the three exterior LF transmitters 4 to 6 transmitting the first response request signals or the second response request signals are provided to detect that a user carrying the portable device 20 approaches the vehicle 30; however, the invention is not limited to the example in the aforementioned embodiments. Alternatively, one, two, or four or more vehicle-mounted transmitters may be provided in the vehicle, and each of the vehicle-mounted transmitters may transmit the first response request signal or the second response request signal.

The aforementioned embodiments are applied to the vehicle control apparatus 10 which is assembled into not only the welcome system 100 but also a keyless entry system or a passive entry system; however, the invention is not limited to the example described in the aforementioned embodiments. The invention can be applied to a vehicle control apparatus which is assembled only into a welcome system, or a vehicle control apparatus which is assembled into a keyless entry system or a passive entry system.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

The invention claimed is:

1. A vehicle control apparatus comprising:

a vehicle-mounted transmitter which transmits a first response request signal;

a vehicle-mounted receiver which receives a response signal which is transmitted from a portable device as a response to the first response request signal; and a controller which controls the vehicle-mounted transmitter and the vehicle-mounted receiver, and which allows an operation of a vehicle-mounted apparatus for welcoming a user carrying the portable device to a vehicle according to a reception state of the response signal received via the vehicle-mounted receiver, wherein when the controller intermittently transmits the first response request signal at predetermined intervals via the vehicle-mounted transmitter, the controller determines whether or not condition set in advance is established, wherein when the condition is established, the controller transmits a second response request signal, which is different from the first response request signal, via the vehicle-mounted transmitter instead of transmitting the first response request signal, and wherein according to whether or not the vehicle-mounted receiver receives a response signal which is transmitted from the portable device as a response to the second response request signal, the controller stops transmission of the second response request signal, and then the controller suppresses transmission of the first response request signal.

2. The vehicle control apparatus according to claim 1, wherein in a case where the vehicle-mounted receiver does not receive the response signal which is transmitted from the portable device as the response to the second response request signal, or in a case where the vehicle-mounted receiver receives the response signal but verification of an ID code included in the response signal is not established, the controller suppresses the transmission of the first response request signal.

3. The vehicle control apparatus according to claim 1, wherein in a case where the vehicle-mounted receiver receives the response signal which is transmitted from the portable device as the response to the second response request signal and verification of an ID code included in the response signal is established, the controller suppresses the transmission of the first response request signal.

4. The vehicle control apparatus according to claim 1, wherein the second response request signal is a signal which is received by the portable device more easily than the first response request signal.

5. The vehicle control apparatus according to claim 1, wherein the second response request signal is a signal having a transmission pattern, a data format, or signal strength different from that of the first response request signal.

6. The vehicle control apparatus according to claim 1, wherein the second response request signal is a signal having a shorter transmission interval, a longer data length, or stronger signal strength than that of the first response request signal.

7. The vehicle control apparatus according to claim 1, wherein the controller suppresses the transmission of the first response request signal by changing a transmission pattern of the first response request signal, or stopping the transmission of the first response request signal.

8. The vehicle control apparatus according to claim 1, wherein the controller suppresses the transmission of the first response request signal by increasing the transmission interval of the first response request signal.

9. The vehicle control apparatus according to claim 1, wherein a plurality of the vehicle-mounted transmitters are provided, and wherein the controller suppresses the transmission of the first response request signal by reducing a number of vehicle-mounted transmitters which transmit the first response request signals.

10. The vehicle control apparatus according to claim 1, wherein the condition includes a condition that voltage of a battery, which is a power supply of the vehicle, is a threshold value or less.

11. The vehicle control apparatus according to claim 1, wherein the condition includes a condition that the user carrying the portable device has no intention of getting in the vehicle.

12. The vehicle control apparatus according to claim 1, wherein when the condition is not established, the controller continues to transmit the first response request signal, and wherein when the vehicle-mounted receiver receives the response signal which is transmitted from the portable device as the response to the second response request signal, the controller stops the transmission of the second response request signal, and then, re-starts transmission of the first response request signal.

* * * * *